United States Patent [19]

Steiner et al.

[11] Patent Number: 4,500,209

[45] Date of Patent: Feb. 19, 1985

[54] FEED MIXING APPARATUS

[75] Inventors: Marvin B. Steiner; Roy I. Steiner, both of Orrville, Ohio

[73] Assignee: Sevenson Company, Orrville, Ohio

[21] Appl. No.: 578,853

[22] Filed: Feb. 10, 1984

Related U.S. Application Data

[63] Continuation-in-part of Ser. No. 253,307, Apr. 13, 1981, Pat. No. 4,444,509.

[51] Int. Cl.[3] ..... B01F 15/02; B01F 9/08

[52] U.S. Cl. ..... 366/157; 366/50; 366/186; 366/222; 366/224; 366/227

[58] Field of Search ..... 366/131, 52, 132, 150, 366/133, 158, 135, 184, 219, 336, 222, 337, 57, 230, 59, 56, 66, 80, 154, 293, 156, 157, 165, 186, 196, 223, 224, 227, 228, 229, 603, 306, 295, 296, 25, 27, 28, 38, 42, 50

[56] References Cited

U.S. PATENT DOCUMENTS

| | | | |
|---|---|---|---|
| Re. 23,320 | 1/1951 | Willard et al. | 366/59 X |
| 761,541 | 5/1904 | Ransome | 366/44 |
| 1,260,840 | 3/1918 | Wege | 366/44 |
| 1,756,390 | 4/1930 | Schneider | 366/44 X |
| 1,861,416 | 5/1932 | Jaeger | 366/44 |
| 1,872,624 | 8/1932 | Eggert | 366/44 |
| 2,006,728 | 7/1935 | Ball | 366/44 |
| 2,522,025 | 9/1950 | Erisman | 34/135 |
| 2,548,733 | 4/1951 | Longenecker | 417/519 X |
| 3,358,973 | 12/1967 | Mitchell et al. | 366/50 |
| 3,415,492 | 12/1968 | Rule | 366/157 |
| 3,606,277 | 9/1971 | Kader | 366/50 |
| 3,792,536 | 2/1974 | McGehee | 34/102 X |
| 3,897,934 | 8/1975 | Phillips | 366/230 X |
| 4,057,225 | 11/1977 | Ferree | 366/157 |
| 4,444,509 | 4/1984 | Steiner et al. | 366/157 |

FOREIGN PATENT DOCUMENTS

| | | | |
|---|---|---|---|
| 1207776 | 7/1958 | France | 366/133 |
| 250568 | 7/1926 | Switzerland | 83/73 |
| 608905 | 5/1978 | U.S.S.R. | 366/50 |

*Primary Examiner*—Philip R. Coe
*Assistant Examiner*—Frankie L. Stinson
*Attorney, Agent, or Firm*—Mack D. Cook, II

[57] ABSTRACT

A feed mixing apparatus for use wherever livestock is cared for and fed. The apparatus has a vehicular mounted frame, a hopper assembly for receiving feed constituents, a cylindrical drum with internal spiral mixing and conveying blades, a cylindrical feed pipe extending from the front of the mixer through the hopper assembly and axially into the drum, a feeder screw auger shaft inside the feed pipe, and drive means for unidirectional rotation of the drum and bidirectional rotation of the auger shaft.

8 Claims, 10 Drawing Figures

FEED MIXING APPARATUS

CROSS-REFERENCE TO A RELATED APPLICATION

This is a continuation-in-part of United States Application Serial No. 253,307, filed Apr. 13, 1981, now U.S. Pat. No. 4,444,509, Feed Mixing Apparatus, Marvin B. Steiner and Roy I. Steiner, inventors.

BACKGROUND OF THE INVENTION

This invention relates to a feed mixing apparatus for use wherever livestock is cared for and fed. A farmer or rancher has an obligation every day of the year to mix and deliver feed for animal consumption. There are also many other daily chores to which to attend. The "feed time" chore must be handled in the shortest possible time at the lowest possible cost, using inexpensive and easily maintained equipment and wasting little of the feed constituents or the mixed feed.

The mixing apparatus for livestock feed constituents, the subject matter of U.S. Pat. No. 4,444,509, embodies certain components which were old in the art: a frame, a cylindrical drum with front and rear walls and internal spiral mixing and conveying blades rotatably mounted on the frame, the front wall of the drum having an axial opening and a funnel-shaped hopper unit supported on the front of said frame for receiving unmixed feed constituents and having an opening for moving said feed constituents toward the interior of the drum for mixing therein.

In Claim 1 of U.S. Pat. No. 4,444,509, the broadest subject matter of improvements to the art are: that feed constituents move from the opening in the hopper unit into an upwardly opening semi-cylindrical front segment of a feed pipe extending into the drum through the axial opening in the drum front wall as a fully cylindrical medial sleeve segment and having within the drum an upwardly opening semi-cylindrical rear segment, the feed pipe rear segment directing feed constituents toward the drum rear wall and being open to receive mixed feed for discharge from the drum, the hopper unit further having an opening adjacent the front feed pipe segment for discharging mixed feed toward a delivery point; that a rotatable feeder screw auger shaft extends from the front feed pipe segment and through the medial feed pipe segment and through the drum axially of the spiral mixing and conveying blades; and, that a drive means is mounted on the frame for selective rotation of the drum and the feeder screw auger shaft, the drive means having components to provide a unidirectional rotational movement for the drum so that either feed constituents or mixed feed will always be moving toward the rear feed pipe segment, the drive means also having components to provide a bidirectional rotational movement for the feeder screw auger shaft so that feed constituents will be moving from the hopper unit and into the rotating drum, or, so that mixed feed will be moving from the rear pipe segment and a rotating drum into the front feed pipe segment and through the opening in the hopper unit for discharging mixed feed toward a delivery point.

Commercial embodiments of the feed mixing apparatus of U.S. Pat. No. 4,444,509 have been well accepted by farmer customers, particularly for use in permanent or semi-permanent farm or barnyard installations. On the other hand, ranchers or other users require the transport of mixed feed over long distances, from the feed constituent storage point to the mixed feed delivery point. Accordingly, this invention utilizes subject matter from U.S. Pat. No. 4,444,509 and incorporates additional improvements to provide a readily movable feed mixing apparatus which may be loaded with large quantities of feed constituents and then moved, while mixing feed in transit, for delivery to the animals needing the mixed feed.

SUMMARY OF THE INVENTION

The object of the invention is to provide a readily movable, efficient, inexpensive to acquire and to operate, and easy to maintain, feed mixing apparatus; an apparatus comprising a combination of elements which may be loaded with large quantities of feed constituents and then moved, while mixing feed in transit, for delivery to the animals needing the mixed feed.

These and other objects of the invention, as well as the operating advantages thereof, will be apparent in view of the following drawings and specification.

Generally described, a mixing apparatus for livestock feed constituents embodying the invention has a frame. A cylindrial drum with front and rear walls and internal spiral mixing and conveying blades is mounted for unidirectional rotation, by a drive means, on the frame. The front wall of the drum has an axial opening. A hopper assembly is supported on the frame in front of the drum. The hopper assembly receives unmixed feed constituents for movement toward the interior of the drum for mixing therein. A feed pipe extends from the hopper assembly and into the drum through the axial opening in the drum front wall and axially of the spiral mixing and conveying blades for directing feed constituents toward the drum rear wall and to receive mixed feed for discharge from the drum. A feeder screw auger shaft is mounted for bidirectional rotation, by a drive means, within the feed pipe so that feed constituents will be moving from the hopper assembly and into the rotating drum, or, so that mixed feed will be moving from the rotating drum toward said hopper assembly.

According to the invention, the drum carries a circular shroud ring projecting in front of the drum front wall and terminating adjacent the hopper assembly. The outer face of the drum front wall has attached thereto, within the shroud ring, a series of radial paddles. The hopper assembly has front, side and rear walls forming an open box for receiving the feed constituents. The rear wall of the hopper assembly, below the box, terminates at a substantially circular opening having a diameter slightly less than the diameter of the drum shroud ring and substantially greater than the diameter of the axial opening in the drum front wall. The front wall and rear walls of the hopper assembly, below the box, extend downwardly below the feed pipe forming a chamber for holding feed constituents before movement thereof by the feeder screw auger shaft into the rotating drum. The feed pipe has a front segment projecting in the front of the hopper assembly and a semi-cylindrical upwardly opening medial segment extending from the hopper assembly and through the larger circular opening the hopper assembly rear wall and the smaller axial opening in the drum front wall. The projecting feed pipe segment has an opening for discharging mixed feed from the rotating drum toward a delivery point.

THE DRAWINGS

DETAILED DESCRIPTION OF THE INVENTION

Figure 8A:
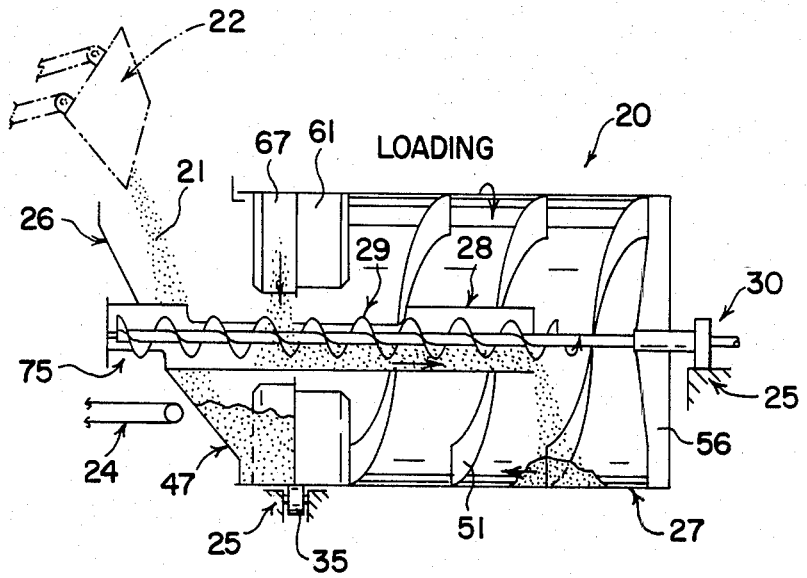
Figure 8B:
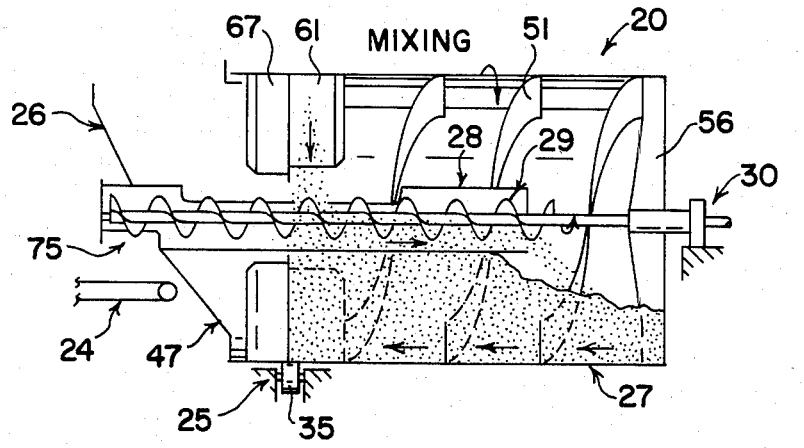
Figure 8C:
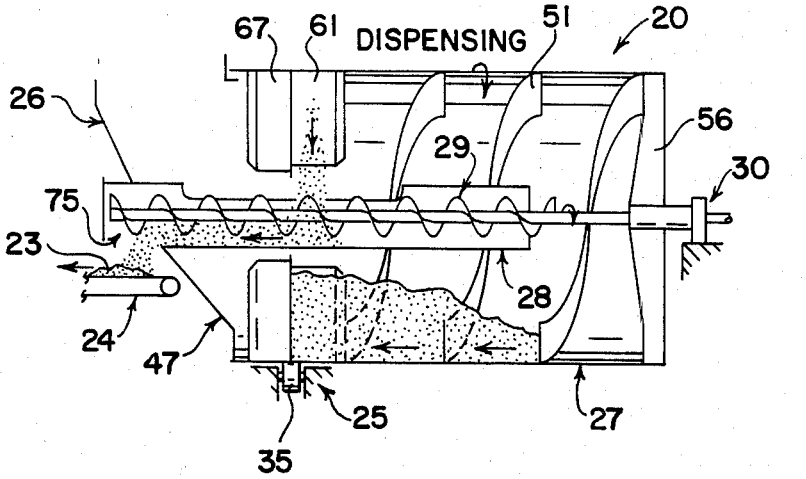

A feed mixing apparatus according to the invention is referred to generally by the numeral 20. The function and purpose of an apparatus 20, as shown in FIGS. 8A–C, is to mix and discharge various feed constituents 21 for animal consumption. The feed constituents 21 are selectively delivered to the apparatus 20 as by a bulk loader 22. After mixing by the apparatus 20, the mixed feed 23 is distributed as by a delivery conveyor 24.

A feed mixer 20 has six primary or basic components. A vehicular mounted generally rectangular and readily movable frame 25 is positioned by the user, as required, for loading of feed constituents 21 or for delivery of mixed feed 23. The front of the frame 25 supports a hopper assembly 26 for receiving the feed constituents 21 from the bulk loader 22. The medial portion of the frame 25 rotatably mounts a cylindrical drum 27 with internal spiral mixing and conveying blades. A cylindrical feed pipe 28 extends from the front of the mixer 20 through the hopper assembly 26 and axially into the drum 27. A feeder screw auger shaft 29 is inside the feed pipe 28 extends from the front of the mixer 20 through the medial portion of the hopper assembly 26 and into the drum 27. The rear of the frame 25 mounts a drive means 30 for unidirectional rotation of the drum 27 and bidirectional rotation of the feeder screw auger shaft 29.

The frame 25

The rectangular frame 25 is fabricated as a weldment may comprise a front cross beam 31 connected by two side channels 32 to rear cross beams 33 and 34. Attached to the inside face of each channel 32 is a bracket mounted roller 35 for supporting the front portion of the rotatable drum 27. The front end of each channel 32 may have attached thereto two support channels 36 for mounting of an optional delivery conveyor 24. The front end of each channel 32 has attached thereto two upwardly directed brackets 37 for attachement to and support of the hopper assembly 26. The rear cross beam 33 carries a pedestal 38 for bearing block mounting of the rear portion of the rotating drum 27. The pedestal 38 may carry a lateral bracket 39 for mounting of the feeder screw auger shaft drive motor component of the drive means 30.

The hopper assembly 26

The hopper assembly 26 supported on the frame 25 in front of the drum 27 is fabricated as a weldment. The hopper assembly 26 has an open box formed by a front wall 40 connected by two side walls 41 to a rear wall 42, for receiving feed constituents 21.

Below the receiving box, the hopper rear wall 42 has opposed edges 43 terminating at a substantially circular opening indicated at 44 for communication with the interior of the drum 27. Adjacent the opening 44, the rear face of the rear wall 42 carries a substantially circular ring 45. A resilient L-shaped annular element 46 may be attached to the ring 45 to partially baffle or close out the area between the stationary hopper assembly 26 and the rotating drum 27.

Below the receiving box, the hopper front wall 40 and side walls 41 are generally funnel-shaped, extending downwardly around the feed pipe 28. Below the feed pipe 28, the walls 40 and 41 merge to form a generally clam-shell shaped lower hopper portion indicated at 47. The lower hopper wall portion 47 forms a chamber for holding feed constituents 21 before movement thereof by the feeder screw auger shaft 29 rotating within the feed pipe 28 into the interior of the rotating drum 27. The hopper assembly 26 is mounted on the frame 25 by connection of the frame brackets 37 to the lower hopper wall portion 47.

The drum 27

The drum 27 is fabricated as a weldment and may comprise a front wall 48 connected by a cylindrical side wall 49 to a rear wall 50. The drum 27 also has two continuous flights of spiral mixing and conveying blades 51 for moving feed constituents 21 or mixed feed 23 toward the drum front wall 48. The drum front wall 48 has an axial opening 52 to receive the feed pipe 28. The diameter of the hopper assembly rear wall opening 44 is substantially greater than the diameter of the drum front wall opening 52.

The rear wall 50 of the drum 27 has an axial sleeve shaft 53. The outer end of shaft 53 is rotatably mounted in a bearing block 54 carried by the frame pedestal 38. A feeder screw drive shaft 29A extends coaxially through the sleeve shaft 53 and has an inner end connected to the rear end of the rotatable feeder screw auger shaft 29 by a coupling 55.

The inner end of the drum sleeve shaft 53 provides the axial component for a series of radial ribs 56. A drum 27 may have four equally spaced rib elements 56 with radially inner ends connected, as at 57, to the shaft 53. The rearwardly directed edge of each rib element 56 conforms to the inner face of the rear drum wall 50 and is connected thereto, as at 58. Together, the ribs 56 provide a structure which strengthens the shaft 53 and strengthens the rear of the drum 27. Two opposed ribs 56 also are connected, as at 59, to the rear ends of the spiral mixing and conveying blades 51 which are also connected to the inner surface of the drum side wall 49, as at 60.

The inner face of the drum front wall 48 carries a series of radial paddles 61 positioned around the drum opening 52. The paddle 61 function to sequentially and continuously direct feed constituents 21 or mixed feed 23, conveyed by the spiral blades 51, onto a semi-cylindrical upwardly opening medial segment (76, as hereinafter described) of a feed pipe 28 for movement by a rotating feeder screw auger shaft 29 into or from the interior of a rotating drum 27.

Figure 7:
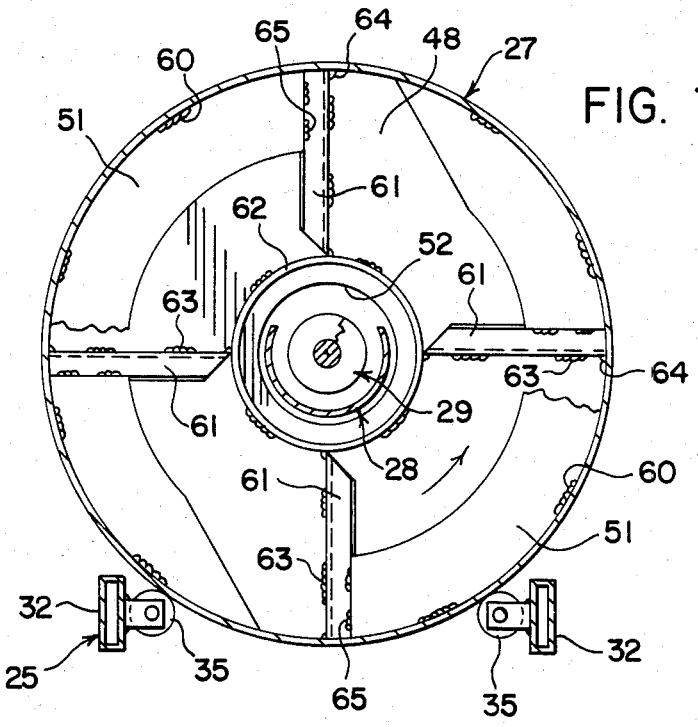
FIG. 7 is a cross-section, taken substantially as indicated on line 7—7 of FIG. 4; and, FIGS. 8A–C are schematic sequential views showing the cooperative relationship of the components of the feed mixer.

As shown (see FIGS. 4 and 7), four equally spaced paddle elements 61 have radially inner ends connected to a flange ring 62 positioned around the drum opening 52. The forwardly directed edge of each paddle element 61 conforms to the inner face of the drum front wall 48 and is connected thereto, as at 63. Also, the radially outer end of each paddle element 61 may be connected to the drum side wall 49, as at 64. Two opposed paddles 61 also are connected, as at 65, to the forward ends of the spiral mixing and conveying blades 51.

The drum 27 carries a circular shroud ring 66 projecting beyond the drum front wall 48. The diameter of the hopper assembly rear wall opening 44 is slightly less than the diameter of the ring 66. The outer face of the drum front wall 48 carries a series of radial paddles 67 positioned around the drum opening 52. The paddles 67 function to sequentially and continuously direct feed constituents 21 from within the hopper assembly 26, particularly from below the feed pipe 28 and within the holding chamber provided by the lower hopper wall portion 47 on to the semi-cylindrical upwardly opening medial pipe segment (76, as hereinafter described) of a feed pipe 28 for movement by a rotating feeder screw auger shaft 29 into the interior of the rotating drum 27.

Figure 6:
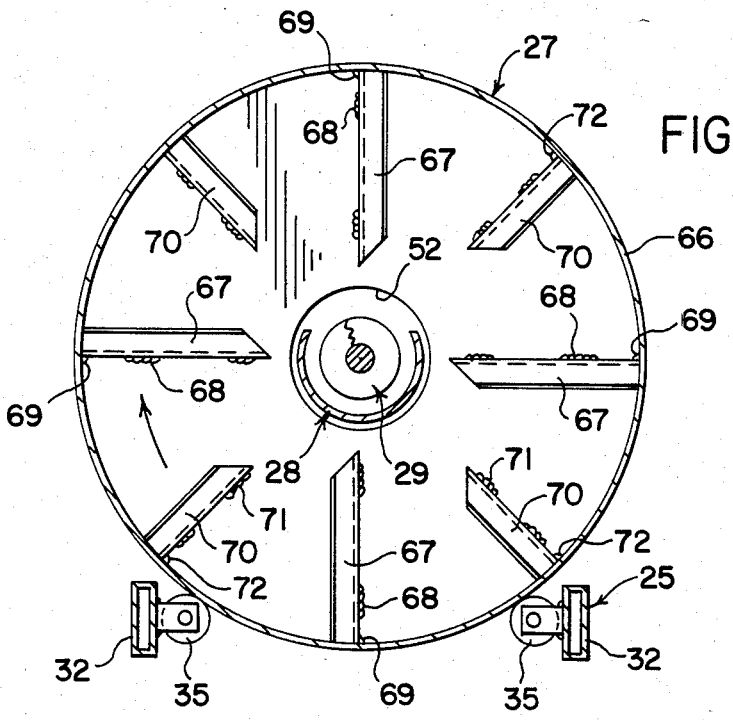
FIG. 6 is a cross-section, taken substantially as indicated on line 6—6 of FIG. 4.

As shown (see FIGS. 4 and 6), four equally spaced paddle elements 67 are positioned around the drum opening 52. The rearwardly directed edge of each paddle element 67 comforms to the outer face of the drum front wall 48 and is connected thereto, as at 68. Also, the radially outer end of each paddle element 67 may be connected to the drum shroud ring 66, as at 69.

Figure 5:
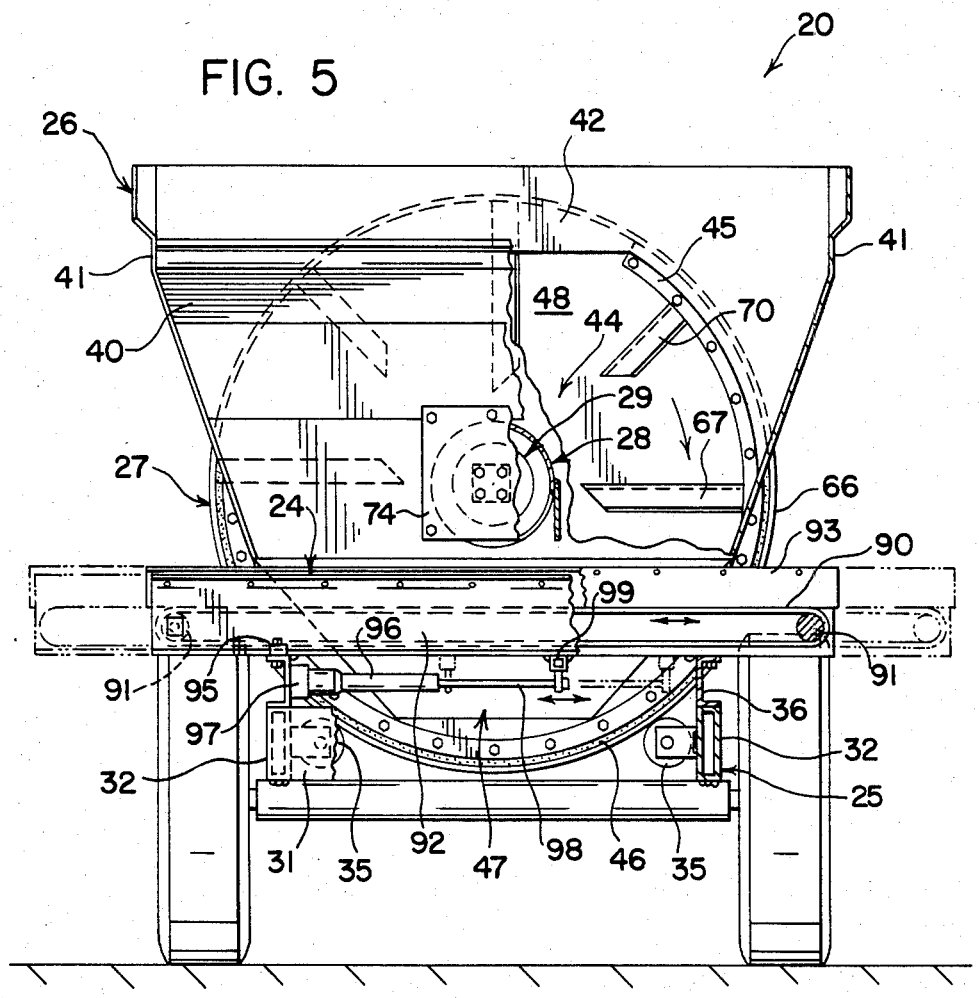
FIG. 5 is a front end view, partially broken away, taken substantially as indicated on line 5—5 of FIG. 4.

In the embodiment of a feed mixing apparatus 20 herein disclosed, the generally inward conveying action of the larger paddle elements 67 is augmented by shorter interposed radial paddles 70. As shown (see FIGS. 5 and 6), four equally spaced paddle elements 70 are positioned around the drum opening 52. The rearwardly directed edge of each paddle element 70 conforms to the outer face of the drum front wall 48, and is connected thereto, as at 71. Also, the radially outer end of each paddle element 70 may be connected to the drum shroud ring, as at 72.

The feed pipe 28

The feed pipe 28 is fabricated from a cylinder of tubing or pipe. A feed pipe 28 has a front segment 73 projecting through the front wall 40 of the hopper assembly 26. The open end of the feed pipe 28 is closed, as by a removable inspection plate 74. The projecting front segment 73 has an opening indicated at 75, exteriorly of the hopper assembly 26. As shown, the opening 75 discharges mixed feed 23 from the rotating drum 27 onto a delivery conveyor 24.

The feed pipe 28 has a semi-cylindrical upwardly opening medial segment 76 which extends from the medial portion of the hopper assembly 26 and through the rear wall opening 44 and axially of the radial paddle 67 and 70 and through the drum opening 52 and axially of the radial paddles 61 and the spiral mixing and conveying blades 51.

As shown, the feed pipe 28 terminates within the drum 27 in a fully cylindrical rear segment 77. The terminal segment 77 extends beyond the medial segment 76 to coaxially enclose the feeder screw auger shaft 29 so that feed constituents 21 are moved into the rear portion of the drum 27.

Figure 1:
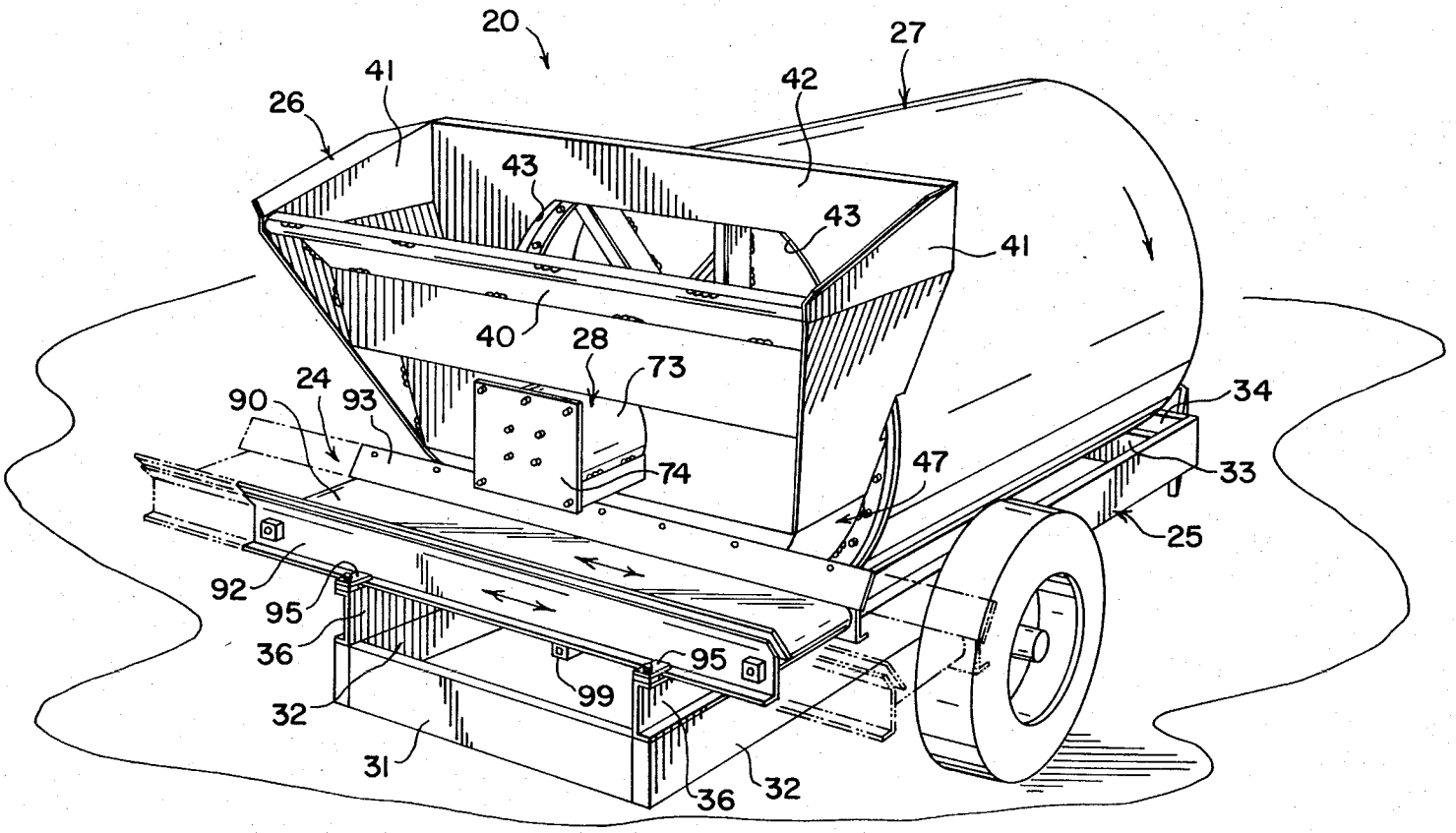
FIG. 1 is an isometric view of the front end of a feed mixing apparatus according to the invention.
Figure 2:
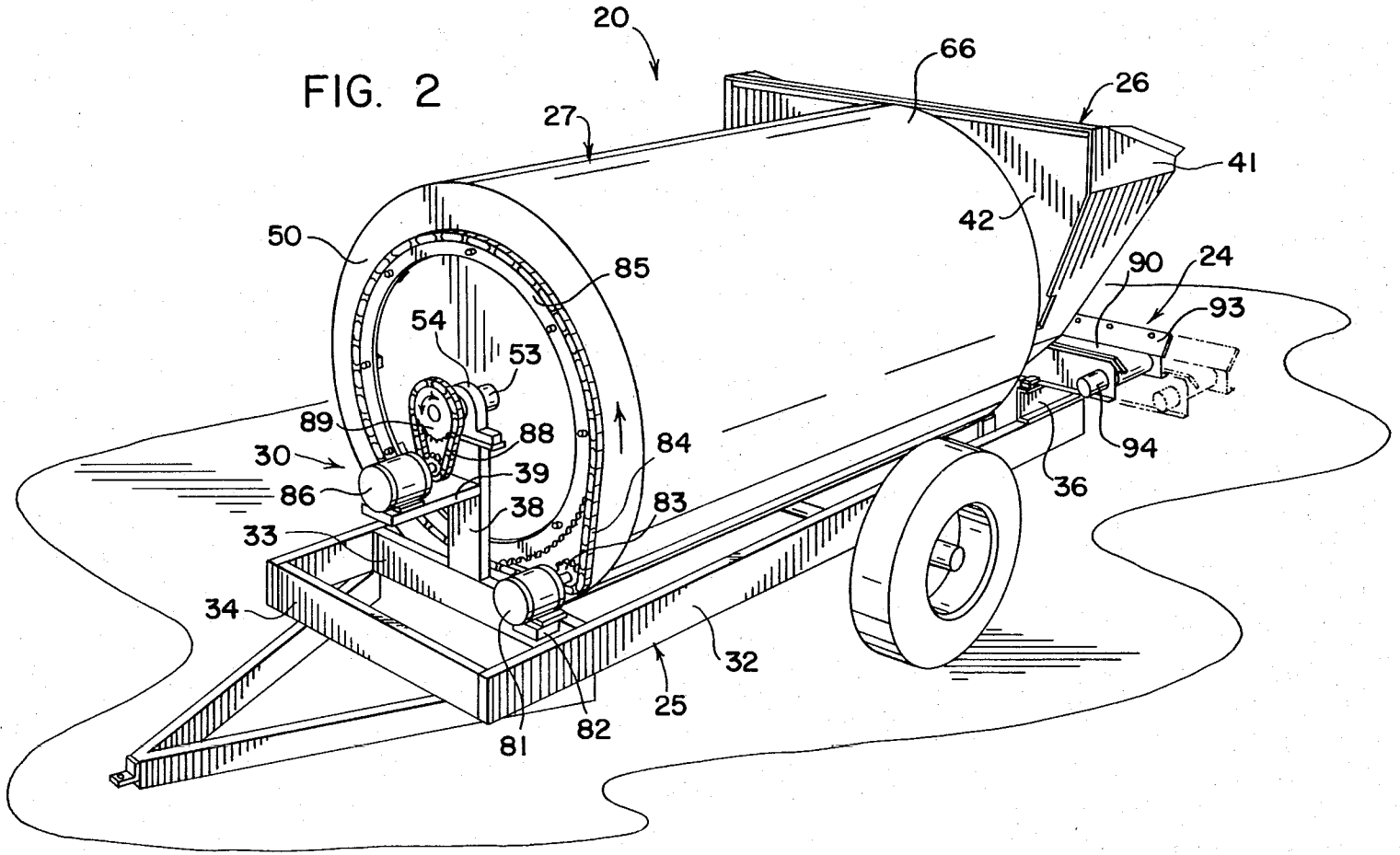
FIG. 2 is an isometric view of the rear end of the feed mixer.
Figure 3:
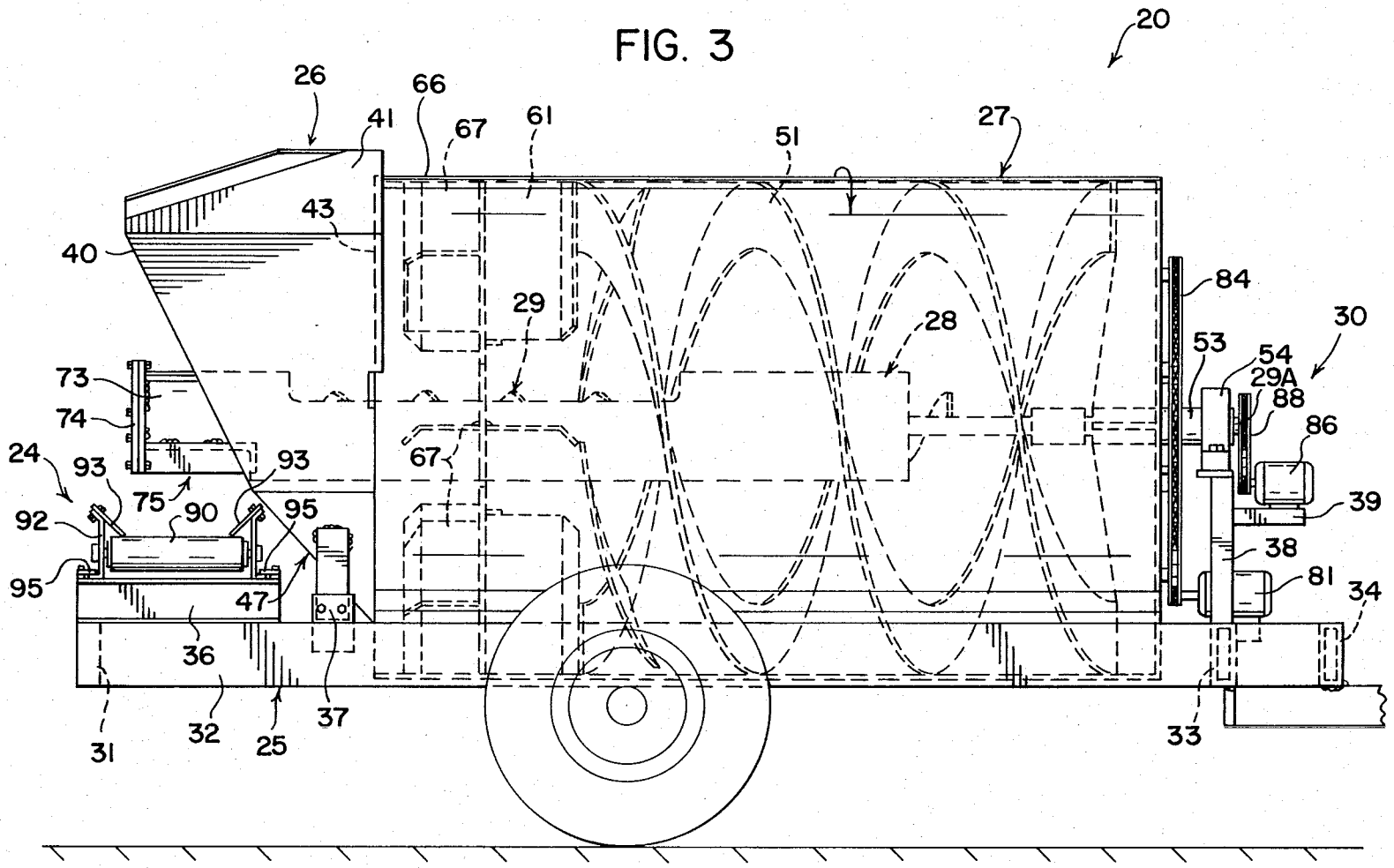
FIG. 3 is a side elevation of the feed mixer.
Figure 4:
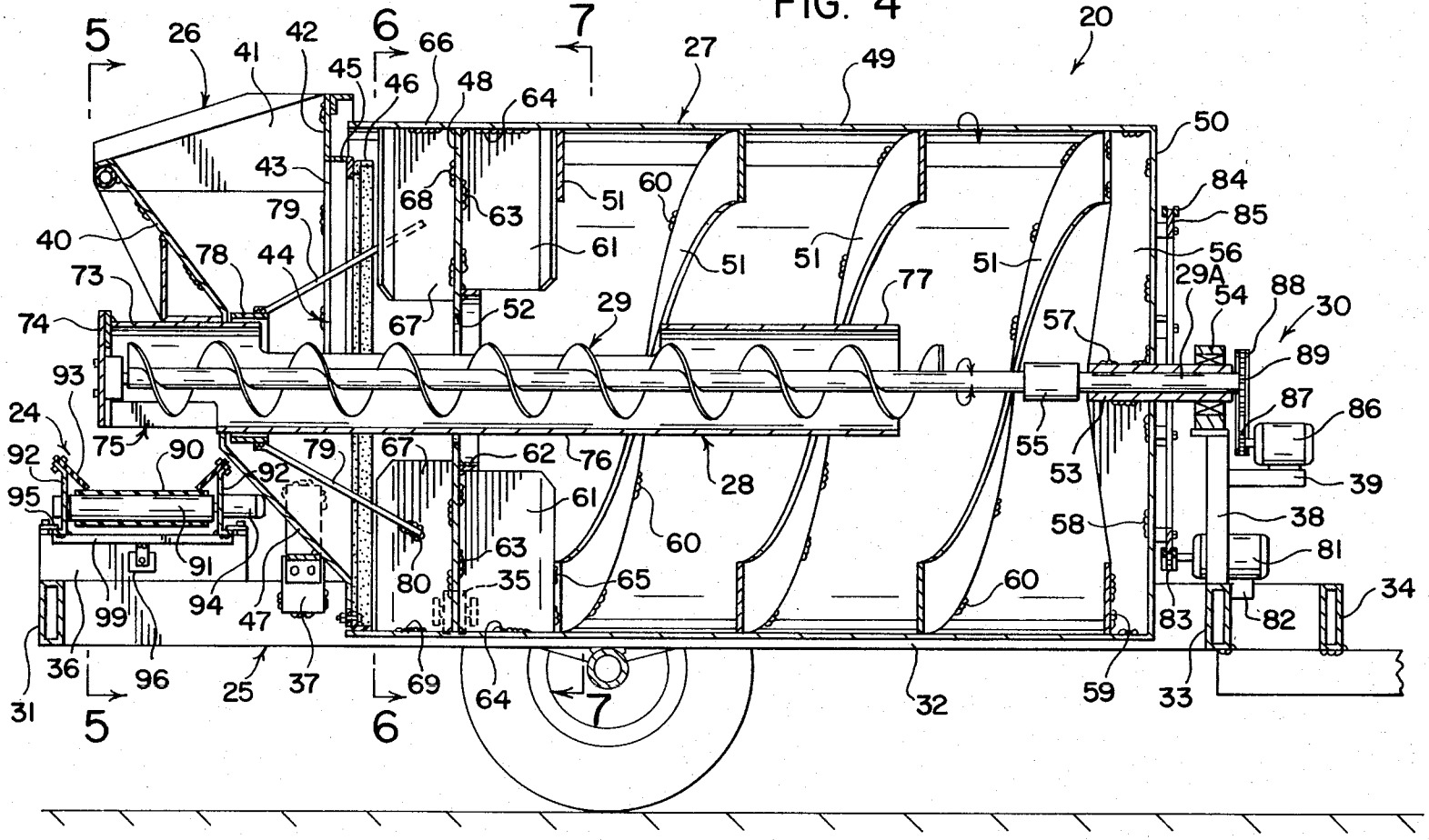
FIG. 4 is a side elevation, in section, of the feed mixer.

As shown in FIG. 4, within the hopper assembly 26 a rotatable ring collar 78 is positioned around the rear end of the feed pipe front segment 73 and adjacent the front end of the semi-cylindrical segment 76. The ring collar 78 is carried by a series of diverging strut rods 79 extending through the hopper assembly rear wall opening 44 and into the drum shroud ring 66. The base end of the strut rods 79 may be connected, as at 80, to the exterior drum paddles 67. The strut rods 79 function to reduce compaction or "bridging" of feed constituents 21 within the hopper assembly 26 before movement thereof into the drum 27.

The drive means 30

The drive means 30 is a combination of various components which will provide for variable speed rotational movement of the drum 27 and the feeder screw auger shaft 29. Certain of these components are intended to provide a unidirectional rotational movement for the drum 27 so that the exterior drum paddles 67 and 70 will always be moving feed constituents 21 toward the upwardly opening feed pipe segment 76 and the drum opening 52, and, so that the spiral mixing and conveying blades 51 within the drum will always be moving feed constituents 21 or mixed feed 23 toward the drum opening 52, the interior drum paddles 61 and the upwardly opening feed pipe segment 76. Others of these components are intended to provide a bidirectional movement for the feeder screw auger shaft 29 so that the feed constituents 21 will be moving from the hopper assembly 26 into the interior of the rotating drum, or, so that the mixed feed 23 will be moving from the interior of the rotating drum and through the hopper assembly 26 for movement toward the feed pipe front segment opening 75 at the front of the feed mixing apparatus 20.

As shown, a drum drive motor 81 may be mounted on a base 82 secured to a frame rear cross beam 33. The drive shaft of motor 81 carries a sprocket 83 engaging an endless drive chain 84. A drive ring 85, secured to the rear drum wall 50, is engaged by the drive chain 84 for variable speed unidirectional rotation of the drum 27. A feeder screw auger shaft drive motor 86 may be mounted on the frame lateral bracket 39. The drive shaft of motor 86 carries a sprocket 87 engaging an endless drive chain 88. A drive sprocket 89 on the outer end of the feeder screw drive shaft 29A is engaged by the drive chain 88 for variable speed bidirectional rotation of the feeder screw auger shaft 29 through the coupling 55.

The delivery conveyor 24

The use of a delivery conveyor 24 as an integral component of a feed mixer 20 is a preferred, but optional with the user, feature. As shown, the lateral discharge delivery conveyor 24 is carried on the frame support channels 36 below the delivery opening 75 for mixed feed 23 in the projecting front end of the feed pipe 28.

The delivery conveyor 24 has an endless belt 90 revolving around belt rollers 91. The belt rollers 91 are rotatably carried by opposed side channels 92 having an outwardly directed upper flange for mounting of side plates 93 overlying the belt 90. One belt roller 91 is connected to a belt drive motor 94 mounted on the inner side channel 92. The belt drive motor 94 is reversible for bidirectional movement of the conveyor belt 90.

Also as shown (see FIG. 5), the side channels 92 may be mounted on the frame support channels 36 by clip brackets 95 so that the delivery conveyor 24 may be shifted laterally (as shown by the chain lines) to either side of the feed mixing apparatus 20 for convenient discharge of mixed feed 23 at the animal feeding point.

The delivery conveyor 24 may be laterally shifted as by a cylinder 96. The cylinder 96 may be base mounted on a bracket 97 carried on a frame side channel 32. The piston rod 98 of the shifting cylinder 96 is connected to a bracket on an actuator bar 99 connected to the underside of the conveyor side channels 92.

What is claimed is:

1. In a mixing apparatus for livestock feed constituents having a frame, a cylindrical drum with front and rear walls and internal spiral mixing and conveying blades mounted for unidirectional rotation on said frame, said drum front wall having an axial opening, a hopper assembly supported on said frame in front of said drum, a feed pipe extending from said hopper assembly and into said drum through said axial opening and axially of said spiral mixing and conveying blades, and a feeder screw auger shaft mounted for bidirectional rotation in said feed pipe, the improvements wherein:

said drum carries a circular shroud ring projecting in front of said drum front wall and terminating adjacent said hopper assembly;

the outer face of said drum front wall has thereon, within said shroud ring, a series of radial paddles;

said hopper assembly has front, side and rear walls forming a box for receiving said feed constituents, said hopper assembly rear wall, below said box, terminating at a substantially circular opening having a diameter slightly less than the diameter of said drum shroud ring and substantially greater than said drum front wall axial opening, said hopper assembly front and side walls, below said box, extending downwardly below said feed pipe forming a chamber for holding said feed constituents; and, said feed pipe has a front segment projecting in the front of said hopper assembly and a semi-cylindrical upwardly opening medial segment extending from said hopper assembly and through said hopper assembly and through said hopper assembly rear wall circular opening and said drum front wall axial opening, said projecting feed pipe front segment having an opening for discharging mixed feed from said drum toward a delivery point.

2. A mixing apparatus according to claim 1, wherein said hopper assembly front and side wall, below said feed pipe, merge to form a generally clam-shell shaped lower portion and said chamber for holding said feed constituents.

3. A mixing apparatus according to claim 1, wherein a resilient annular element is positioned around said hopper assembly rear wall circular opening to partially baffle the area between said stationary hopper assembly and said rotating drum.

4. A mixing apparatus according to claim 1, wherein the inner face of said drum front wall has thereon, around said axial opening, a series of radial paddles.

5. A mixing apparatus according to claim 1, wherein said feed pipe has a cylindrical rear segment extending into said drum beyond said semi-cylindrical upwardly opening medial segment.

6. A mixing apparatus according to claim 1, wherein a lateral discharge delivery conveyor is supported on said frame below said discharge opening for mixed feed in said projecting feed pipe front segment.

7. A mixing apparatus according to claim 6, wherein said delivery conveyor has an endless belt mounted for bidirectional movement toward either side of said mixing apparatus.

8. A mixing apparatus according to claim 7, wherein side channels for mounting said endless belt may be shifted laterally to either side of said mixing apparatus.

* * * * *

UNITED STATES PATENT AND TRADEMARK OFFICE

CERTIFICATE OF CORRECTION

PATENT NO. : 4,500,209

DATED : February 19, 1985

INVENTOR(S) : Marvin B. Steiner and Roy I. Steiner

It is certified that error appears in the above-identified patent and that said Letters Patent are hereby corrected as shown below:

Col. 2, line 24, "cylindrial" should read -- cylindrical--;

Col. 2, line 62, before "front" delete -- "the" --;

Col. 2, line 65, before "the hopper" insert -- in --;

Col. 2, line 67, after "pipe" insert -- front --;

Col. 3, line 50, before "may" insert -- and --;

Col. 5, line 25, "comforms" should read -- conforms --.

Signed and Sealed this

*Twentieth* Day of *August 1985*

[SEAL]

*Attest:*

DONALD J. QUIGG

*Attesting Officer* *Acting Commissioner of Patents and Trademarks*